US009194079B2

(12) United States Patent
Kudou et al.

(10) Patent No.: US 9,194,079 B2
(45) Date of Patent: Nov. 24, 2015

(54) METAL FILAMENT BODY CONNECTING METHOD AND CONNECTING DEVICE

(71) Applicant: BRIDGESTONE CORPORATION, Chuo-ku, Tokyo (JP)

(72) Inventors: Eiji Kudou, Nasushiobara (JP); Toshihiro Kami, Miyaki-gun (JP)

(73) Assignee: BRIDGESTONE CORPORATION, Tokyo (JP)

( * ) Notice: Subject to any disclaimer, the term of this patent is extended or adjusted under 35 U.S.C. 154(b) by 0 days.

(21) Appl. No.: 14/353,694

(22) PCT Filed: Oct. 30, 2012

(86) PCT No.: PCT/JP2012/078074

§ 371 (c)(1),
(2) Date: Apr. 23, 2014

(87) PCT Pub. No.: WO2013/065698

PCT Pub. Date: May 10, 2013

(65) Prior Publication Data

US 2014/0298770 A1 Oct. 9, 2014

(30) Foreign Application Priority Data

Nov. 1, 2011 (JP) ..... 2011-240488

(51) Int. Cl.
*D07B 1/06* (2006.01)
*B65H 69/06* (2006.01)
(Continued)

(52) U.S. Cl.
CPC ..... *D07B 1/062* (2013.01); *B21F 15/04* (2013.01); *B21F 15/06* (2013.01); *B65H 69/06* (2013.01); *D07B 7/167* (2013.01); *D07B 9/00* (2013.01); *Y10T 29/49929* (2015.01)

(58) Field of Classification Search
CPC ..... D07B 7/16; D07B 7/167; D07B 1/062; B65H 69/06; B21F 7/00
USPC ..... 57/22, 23; 28/209, 210, 141; 140/93.6, 140/118, 149
See application file for complete search history.

(56) References Cited

U.S. PATENT DOCUMENTS 261,706 A * 7/1882 Harris ..... 140/117
1,345,375 A * 7/1920 Lemay ..... 57/22
(Continued)

FOREIGN PATENT DOCUMENTS

CN 101041168 A 9/2007
CN 101541449 A 9/2009
(Continued)

OTHER PUBLICATIONS

International Search Report, dated Jan. 22, 2013, issued in International Application No. PCT/JP2012/078074.
(Continued)

*Primary Examiner* — Shaun R Hurley
(74) *Attorney, Agent, or Firm* — Sughrue Mion, PLLC

(57) ABSTRACT

Provided is a connecting method for connecting facing metal filament bodies. A pair of fixing members fixing the facing metal filament bodies, and a rotating body in which a cutout is arranged-between the pair of fixing members. End portions of a parallel portion of a metal filament body formed by juxtaposing the facing metal filament bodies are fixed by the pair of fixing members and an approximately central portion of the parallel portion of the metal filament body is arranged in a cutout of the rotating body. Next, the facing metal filament bodies are twisted together by rotating the rotating body. The pair of fixing members comprises a cutout and a pressing member and both end portions of parallel portion of the facing metal filament bodies are arranged in cutouts 1A of the pair of fixing members and the end portions are fixed by pressing with the pressing member.

8 Claims, 4 Drawing Sheets

(51) Int. Cl.

| | |
|---|---|
| ***B21F 15/04*** | (2006.01) |
| ***D07B 7/16*** | (2006.01) |
| ***B21F 15/06*** | (2006.01) |
| ***D07B 9/00*** | (2006.01) |

(56) References Cited

U.S. PATENT DOCUMENTS

| | | | | | |
|---|---|---|---|---|---|
| 1,581,794 | A | * | 4/1926 | Haven, Jr. | 140/115 |
| 2,412,795 | A | * | 12/1946 | Abrahamsen | 57/1 R |
| 2,498,920 | A | * | 2/1950 | Holland | 289/17 |
| 2,654,403 | A | * | 10/1953 | Roe | 140/115 |
| 2,765,003 | A | * | 10/1956 | Willis et al. | 140/93 R |
| 2,796,662 | A | * | 6/1957 | Saum | 269/37 |
| 2,831,356 | A | * | 4/1958 | Olov | 74/128 |
| 2,949,939 | A | * | 8/1960 | Milla | 140/115 |
| 3,504,488 | A | * | 4/1970 | Illman | 57/22 |
| 3,526,085 | A | * | 9/1970 | Illman | 57/202 |
| 3,729,913 | A | * | 5/1973 | Wray | 57/22 |
| 3,908,715 | A | * | 9/1975 | Spiessens | 140/111 |
| 4,002,012 | A | * | 1/1977 | Norris et al. | 57/22 |
| 4,765,129 | A | * | 8/1988 | Jodoin et al. | 57/22 |
| 5,494,081 | A | * | 2/1996 | Wiedel | 140/115 |
| 5,921,289 | A | * | 7/1999 | Johnson | 140/93.6 |
| 6,668,870 | B2 | * | 12/2003 | Rossum et al. | 140/118 |
| 7,290,570 | B1 | * | 11/2007 | Spikes | 140/118 |
| 2006/0179909 | A1 | | 8/2006 | Kato et al. | |
| 2009/0308483 | A1 | * | 12/2009 | James | 140/120 |
| 2012/0055578 | A1 | * | 3/2012 | Kodi | 140/149 |

FOREIGN PATENT DOCUMENTS

| | | | |
|---|---|---|---|
| DE | 434138 | C | 9/1926 |
| EP | 0 060 959 | A1 | 9/1982 |
| JP | 50-37590 | | 10/1975 |
| JP | 51-2291 | | 1/1976 |
| JP | 52-38278 | | 3/1977 |
| JP | 54-35738 | | 3/1979 |
| JP | 57-153814 | A | 9/1982 |
| JP | 2009-183951 | A | 8/2009 |

OTHER PUBLICATIONS

Communication dated Jun. 2, 2015 from the State Intellectual Property Office of People's Republic of China in counterpart Application No. 201280053935.5.

* cited by examiner

METAL FILAMENT BODY CONNECTING METHOD AND CONNECTING DEVICE

CROSS REFERENCE TO RELATED APPLICATIONS

This application is a National Stage of International Application No. PCT/JP2012/078074 filed Oct. 30, 2012, claiming priority based on Japanese Patent Application No. 2011-240488, filed Nov. 1, 2011, the contents of all of which are incorporated herein by reference in their entirety.

TECHNICAL FIELD

The present invention relates to a metal filament body connecting method (hereinafter, also simply referred to as "connecting method") and connecting device (hereinafter, also simply referred to as "connecting device"), and more particularly to a metal filament body connecting method in which a connecting operation is easy and a metal filament body connecting device which is lightweight and has excellent portability.

BACKGROUND ART

A steel cord for reinforcing rubber articles used for a tire or the like is manufactured by twisting a plurality of steel filaments together by a twisting machine. Examples of the steel cord twisting machine include a tubular type twisting machine and buncher type twisting machine; when a steel cord is manufactured, an exchange operation of a steel filament which is a material is indispensable. Therefore, an operation of knotting a steel filament left on the twisting machine and a newly exchanged steel filament which is a material is performed.

In recent years, for the simplicity of the structure of a steel cord or an increased tenacity of a steel cord, a steel filament having a large diameter is increasingly used. Accordingly, in an operation of knotting steel filaments together which has conventionally been performed manually, an operation load is increasing due to the increase in the flexural rigidity as the result of increased diameter of a filament. Further, since the diameter of the knot of steel filaments tends to be large, room for the diameter of a guide hole through which a steel filament of a twisting machine passes becomes insufficient, whereby the knot is hard to pass through the hole, which has been problematic.

As a connecting device of a metal filament body such as a steel filament, Patent Document 1 discloses a method in which A pair of spur gears on which slits and through holes which can hold a metal filament body are provided at an interval are arranged at an interval, the neighborhoods of the ends of metal filament bodies are held at the through holes and slits of these spur gears and the metal filament bodies are bridged such that the neighborhoods of the ends of metal filament bodies are overlapped along the axis direction, and the spur gears are revolved centering on a point between the through hole and the slit as a center of rotation in directions which are opposite to each other, whereby the metal filament bodies are twisted together between these spur gears while restricting the movement outside a spacer in a diameter direction and connected with each other.

Patent Document 2 discloses a connecting device for mechanically connecting the ends of two thin wire rods, the connecting device comprising two legs rotatably connected to each other centering on a common axis, and a fixed wire rod holding member, each of the legs being configured as a grip at one end thereof, and one of the legs having a toothed segment on the other end thereof, and the other one of the legs being configured integrally with a casing at the opposite end, the toothed segment cooperating with a gear having a slit reaching the axis in the casing, and a fixed wire rod holding member(s) being arranged on one side or on both sides of the gear having a slit.

This device functions as a wire rod clamping device in which a gear having a slit can rotate, is connected with a toothed segment via a transmission device such that the device can be driven by the transmission device, and has on one side a cylinder piece which has a similar slit and is coaxially arranged, the cylinder piece having an automatically operated clamping device. While a fixed wire rod holding member is configured as a wire rod guide not having a clamping action, an unrotatable clamping device which can be operated by using a cam disk of a gear having a slit attached to a lever having a toothed segment on the opposite side to a cylinder piece having a slit spacing from the gear by a predetermined distance and which can be operated via a push rod or a ball involving a buffer action by a spring is arranged. Further, Patent Document 3 discloses a tool for twisting wires by providing rotation at a portion where two wires are held to connect the two wires.

RELATED ART DOCUMENTS

Patent Documents

Patent Document 1: Japanese Unexamined Patent Application Publication No. 2009-183951

Patent Document 2: Japanese Unexamined Utility Model (Registration) Application Publication No. S54-35738

Patent Document 3: Japanese Examined Utility Model (Registration) Application Publication No. S51-2291

SUMMARY OF THE INVENTION

Problems to be Solved by the Invention

However, since, in a connecting device according to Patent Documents 1 and 2, left and right holding members are rotated in opposite direction to each other when a metal filament body or a wire rod member is connected, the structure thereof is complex and the weight of the device is heavy, and therefore the device is not suitable for carrying. Since the left and right holding members need to be rotated in opposite directions to each other, twists reside on both ends of a connecting portion of a metal filament body or a wire rod member, thereby possibly generating a kink; therefore, the device is not suitable for connecting a steel filament when a material is exchanged for a twisting machine.

In Patent Document 3, a residual twist as mentioned above is not generated since left and right holding members are not rotated when wires are connected and the wires are twisted and connected by rotating a rotary member on a center portion; however, since a lot of gears are combined and arranged for the rotation of a rotary member, the structure of the device is complex in a similar manner to the above and the weight thereof is heavy, and therefore, the device is not suitable for carrying. Further, in Patent Document 3, although a suitable strength of a clip which holds two wires is not studied at all, a steel filament needs to be fixed by a sufficient strength for connecting by twisting since a steel filament used for a steel cord has a high tensile strength.

Accordingly, an object of the present invention is to overcome such a problem and to provide a metal filament body connecting method in which a connecting operation is easy and a metal filament body connecting device which is lightweight and has excellent portability.

Means for Solving the Problems

In order to solve the above-mentioned problem, the present inventors intensively studied to find that, if the fixation of two metal filament bodies is not enough when the two metal filament bodies are twisted to be connected, the shape of the knot portion of the metal filament bodies is disturbed. Such disturbance of a knot portion may be a cause of a break in a twisting step. On the basis of such findings, the present inventors further intensively studied to find that the above-mentioned problems are resolved by employing the constitution below, thereby completing the present invention.

Specifically, the metal filament body connecting method of the present invention is a metal filament body connecting method of connecting facing metal filament bodies, in which a pair of fixing members fixing the facing metal filament bodies, and a rotating body including a cutout which is rotatable between the pair of fixing members are arranged; both end portions of a parallel portion of a metal filament body formed by juxtaposing the facing metal filament bodies are fixed by the pair of fixing members; an approximately central portion of the parallel portion of the metal filament body is arranged in a cutout of the rotating body; and then, the facing metal filament bodies are twisted together by rotating the rotating body, wherein the pair of fixing members comprises a cutout and a pressing member; both end portions of parallel portion of the facing metal filament bodies are arranged in cutouts of the pair of fixing members; and the both end portions are fixed by pressing with the pressing member.

In the present invention, preferably, the cutouts of the pair of fixing members comprise a metal filament body holding member having a width of 100 to 150% with respect to the diameter of the metal filament body; and the facing metal filament bodies are arranged side by side in a depth direction of the cutouts of the pair of fixing members. In the present invention, preferably, the width of the metal filament body holding member is decreased with respect to the depth direction of the cutouts of the pair of fixing members by an angle of 0.5 to 2.5°. Further, in the present invention, preferably, the rotating body comprises a gear; the gear is engaged with a driving gear including a handle; and the rotating body is rotated by rotating the driving gear by rotating the handle.

The metal filament body of the present invention is characterized by being connected by a metal filament body connecting method of the present invention.

The connecting device of a metal filament body of the present invention is a metal filament body connecting device for connecting filament bodies, comprising a pair of fixing members which can fix both end portions of a parallel portion of a metal filament body formed by juxtaposing the facing metal filament bodies, a rotating body including a cutout which is rotatably arranged between the pair of fixing members and which can hold an approximately central portion of the parallel portion of the metal filament body, and a driving gear to be engaged with a gear mounted in the rotating body, the pair of fixing members comprising cutouts for holding both end portions of a parallel portion of the metal filament body and a pressing member which fixes a metal filament body by pressing.

In the present invention, preferably, the cutouts of the pair of fixing members comprise a metal filament body holding member having a width of 100 to 150% with respect to the diameter of the metal filament body. In the present invention, preferably, the width of the metal filament body holding member is decreased with respect to the depth direction of the cutouts of the pair of fixing members by an angle of 0.5 to 2.5°. Further, in the present invention, preferably, the driving gear comprises a handle.

Effects of the Invention

According to the present invention, a metal filament body connecting method in which a connecting operation is easy and a metal filament body connecting device which is lightweight and has excellent portability can be provided.

MODE FOR CARRYING OUT THE INVENTION

In the following, a metal filament body connecting method of the present invention will be described in detail by using a metal filament body connecting device of the present invention with reference to the Drawings.

Figure 1:
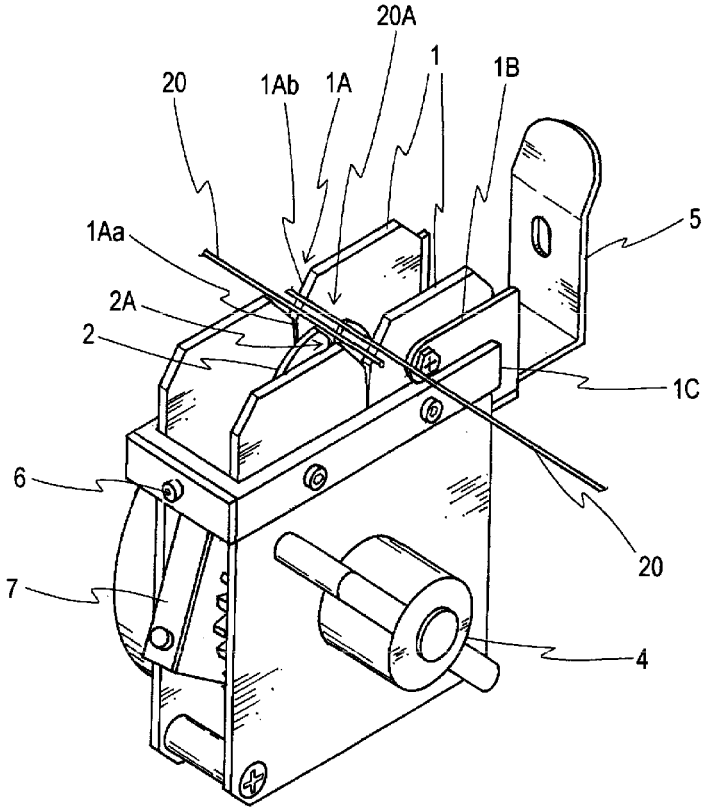
FIG. 1 is a perspective view of a metal filament body connecting device of one suitable embodiment of the present invention.
Figure 2:
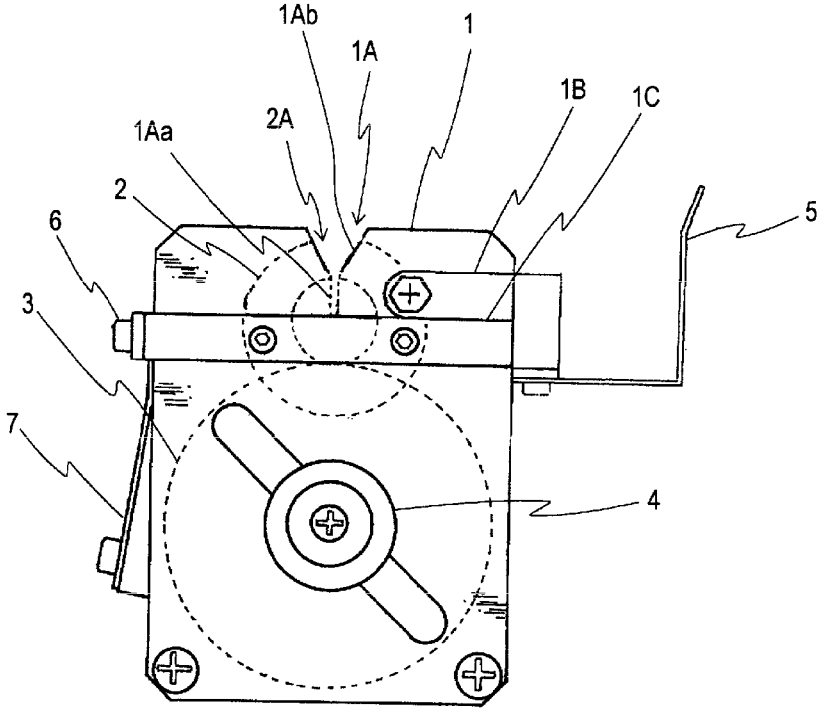
FIG. 2 is a front view of a metal filament body connecting device of one suitable embodiment of the present invention.
Figure 3:
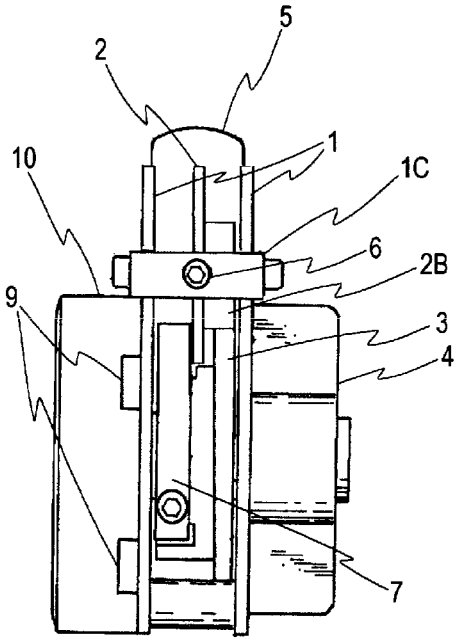
FIG. 3 is a side view of a metal filament body connecting device of one suitable embodiment of the present invention.

FIG. 1 is a perspective view of a metal filament body connecting device of one suitable embodiment of the present invention; FIG. 2 is a front view of a metal filament body connecting device of one suitable embodiment of the present invention; FIG. 3 is a side view of a metal filament body connecting device of one suitable embodiment of the present invention; and FIG. 4 is a transparent perspective view of a metal filament body connecting device of one suitable embodiment of the present invention.

The metal filament body connecting device of the present invention will be described. As illustrated in FIGS. 1 to 4, a metal filament body connecting device of the present invention comprises a pair of fixing members 1, a rotating body 2 including a cutout 2A which is rotatably arranged between a pair of fixing members 1 at appropriate intervals from both fixing members 1. In an illustrated example, the fixing member 1 comprises a cutout 1A, a pressing member 1B, and a pressing base 1C; the cutout 1A of the fixing member 1 comprises a metal filament body holding member 1Aa for holding both end portions of a parallel portion 20A (hereinafter, also simply referred to as "parallel portion of facing metal filament bodies") of a metal filament body formed by juxtaposing facing metal filament bodies 20, and a wide guide portion 1Ab for easily introducing both end portions of the parallel portion 20A of a metal filament body into the metal filament body holding member 1Aa. In the illustrated example, although the pressing member 1B is attached on one end rotatably around an axis, the shape of a pressing member is not restricted to the one in the drawing in the present invention (mentioned below).

Figure 4:
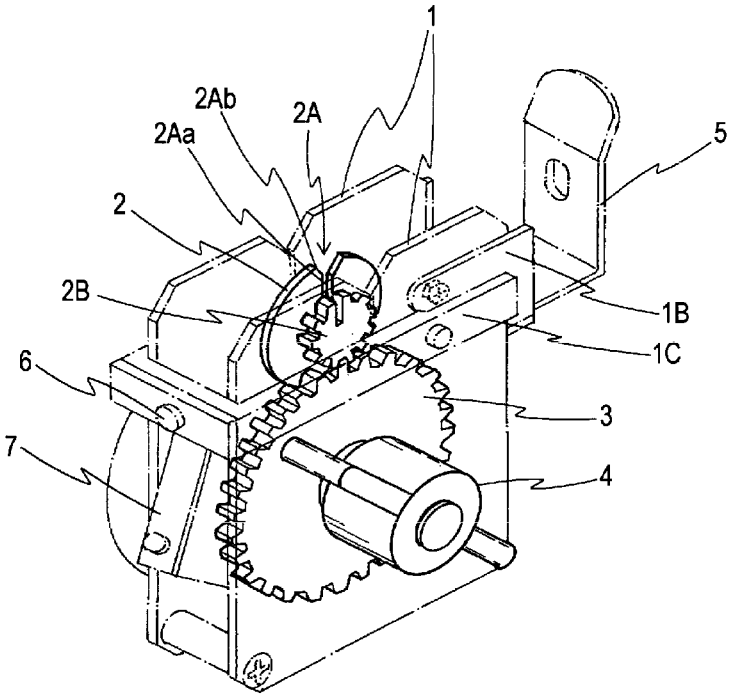
FIG. 4 is a transparent perspective view of a metal filament body connecting device of one suitable embodiment of the present invention.

In the connecting device of the present invention, as illustrated in FIG. 4, a rotating body 2 comprises a gear 2B, and further comprises a driving gear 3 meshing with the gear 2B of the rotating body 2. Although, in the illustrated example, the gear 2B is fixed coaxially with the rotating body 2, the rotating body 2 itself may be constituted as a gear (not illustrated). In the illustrated example, the cutout 2A of the rotating body 2 comprises a metal filament body holding member 2Aa holding an approximately central portion of the parallel portion 20A of the facing metal filament bodies 20, and a guide portion 2Ab for easily introducing an approximately central portion of the parallel portion 20A of facing metal filament bodies into the metal filament body holding member 2Aa. Although, in the illustrated example, the driving gear 3 is provided with a handle 4 and the connecting device has a constitution in which, when the handle 4 is rotated, the driving gear 3 is rotated and the rotating body 2 is rotated together with the gear 2B meshing with the driving gear 3, the configuration of the handle is not limited to the illustrated example.

Next, a method of connecting metal filament bodies by using the above-mentioned connecting device will be described in detail.

Figure 5:
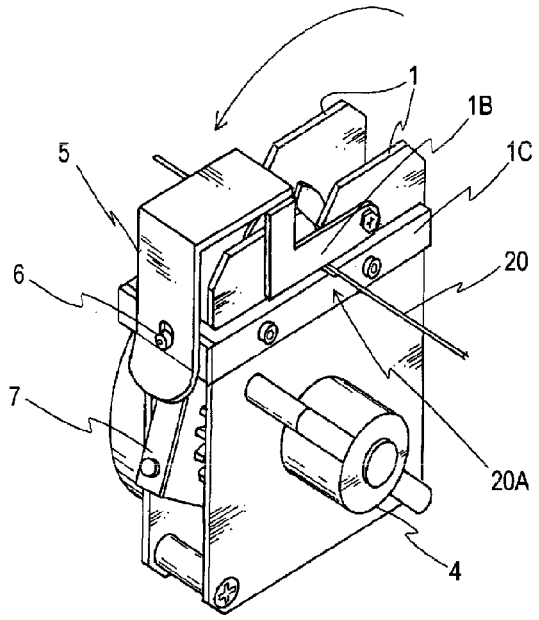
FIG. 5 is a perspective view illustrating a state in which both end portions of a parallel portion of facing metal filament bodies are fixed.

In a metal filament body connecting method of the present invention, as illustrated in FIG. 1, firstly, the facing metal filament bodies 20 are arranged in parallel, and both end portions of a parallel portion 20A of a metal filament body formed by juxtaposing the metal filament bodies 20 are introduced into the cutouts 1A of the pair of fixing members 1 and an approximately central portion of the parallel portion 20A of the facing metal filament bodies are introduced into the cutout 2A of the rotating body 2. In the illustrated example, both end portions of the parallel portion 20A of the metal filament body is held by the metal filament body holding member 1Aa of the fixing member 1, and an approximately central portion is held by a metal filament body holding member 2Aa of the rotating body 2. Subsequently, both end portions of the parallel portion 20A of the metal filament body 20 are fixed by pressing with the pressing member 1B. FIG. 5 is a perspective view illustrating a state in which both end portions of a parallel portion of the facing metal filament bodies 20 are fixed. Thereafter, according to the illustrated example, two metal filament bodies 20 are twisted together to be connected by rotating the driving gear 3 by rotating the handle 4 provided on the driving gear 3 to rotate the rotating body 2.

Figure 6:
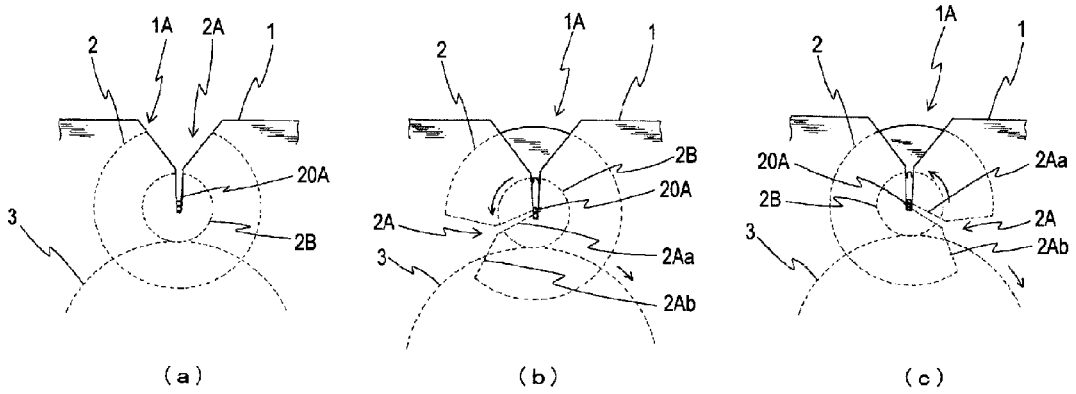
FIGS. 6 (*a*) to (*c*) are explanatory diagrams illustrating states in which a facing parallel portion of a metal filament body fixed by fixing members are twisted together by rotation of a rotating body.

FIG. 6 is an explanatory diagram illustrating states in which the parallel portion 20A of the facing metal filament bodies 20 fixed by a fixing member 1 is twisted together by rotation of the rotating body 2. First, as illustrated in FIG. 6(*a*), both end portions of the parallel portion 20A of the facing two metal filament bodies 20 are introduced into the cutout 1A of the fixing member 1; an approximately central portion is introduced into the cutout 2A of the rotating body 2, by metal filament body holding members 1Aa, 2Aa, respectively. Thereafter, as illustrated in FIGS. 6(*b*) and (*c*), an approximately central portion of the parallel portion 20A of the metal filament body 20 between the pair of fixing members 1 is twisted together by rotating the rotating body 2 while both end portions of the parallel portion 20A of the facing metal filament bodies 20 are remained fixed by the pair of fixing members 1 by rotating the rotating body 2.

Figure 7:
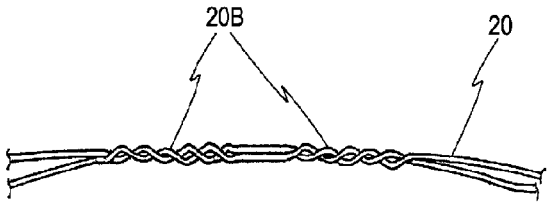
FIG. 7 is a schematic view of a knot portion of a metal filament body connected by using a metal filament body connecting device of the present invention.

In the connecting method of the present invention, as illustrated in FIG. 5, when the metal filament bodies 20 are twisted together to be connected, it is important that both end portions of the parallel portion 20A of the two metal filament bodies 20 arranged at the cutout 1A of the fixing member 1 are fixed by pressing with the pressing member 1B. The tensile strength of a metal filament body used for a steel cord is high, and in particular, metal filament bodies having a diameter larger than 0.40 mm need to be securely fixed in order to connect the metal filament bodies by twisting. This is because, if fixation of both end portions of a parallel portion of the facing metal filament bodies is not enough, the parallel portion of the metal filament bodies moves in a cutout of the fixing member when the rotating body revolves, and the shape of a knot portion formed by twisting the facing metal filament bodies is disturbed. FIG. 7 is a schematic view of a knot portion 20B of the metal filament bodies 20 connected by using a connecting device of the present invention. As illustrated in FIG. 5, since both end portions of a parallel portion 20A of two metal filament bodies 20 to be twisted together are fixed by the pressing member 1B, the knot portion 20B is not disturbed and a favorable shape is obtained.

In the connecting device of the present invention, the pressing member 1B is preferably provided with a mechanism in which a pressing force is always constant in order to stabilize the shape of the knot portion 20B of the metal filament body 20. In the present invention, as illustrated, a plate spring 5 is preferably attached to the end opposite to the rotation axis of the pressing member 1B (see FIGS. 1 to 5). In the illustrated example, a claw 6 for fixing the plate spring 5 is provided on a side surface of the fixing member 1 (see FIGS. 1 to 5). By employing such a configuration, a pressing force can always be made constant, and further, fixation and release of the pressing member 1B become easy, whereby workability is improved. An optimum pressing force for pressing the parallel portion 20A of the facing metal filament bodies 20 varies depending on the diameter of a metal filament body and is appropriately set depending on the diameter. For example, when a metal filament body having a diameter of 0.45 mm is used, a pressing force of a metal filament body is preferably about 65 N. In the connecting device of the present invention, as mentioned above, the configuration of a pressing member is not limited to the illustrated example, and although not illustrated, the configuration may be the one in which, for example, a pressing member is separated from a connecting device and a parallel portion of a metal filament body is pressed from the upward of a connecting device. In such cases, plate springs are provided on both end portions of a pressing member, and claws for fixing a plate spring are provided on both sides of the fixing member, thereby fixing the pressing member.

Figure 8:
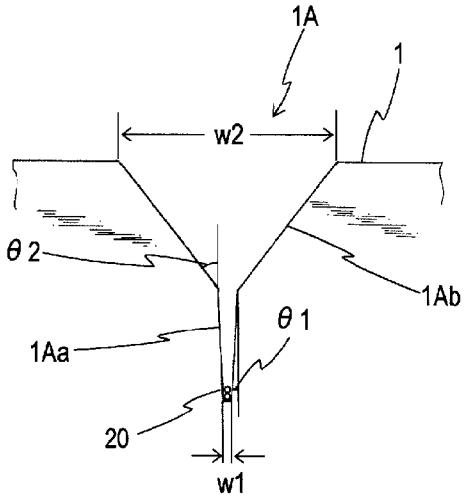
FIG. 8 is an enlarged side view of a fixing member of one suitable connecting device of a metal filament body of the present invention.

FIG. 8 is an enlarged side view of the cutout 1A of one suitable fixing member 1 of a connecting device of the present invention. As stated above, in the connecting device of the present invention, the cutout 1A of the fixing member 1 preferably comprises a metal filament body holding member 1Aa which holds both end portions of a parallel portion of facing metal filament bodies, and a wide guide portion 1Ab which is for easily introducing the end portion of the parallel portion of the facing metal filament bodies into the metal filament body holding member 1Aa. In the present invention, a width w1 of the metal filament body holding member 1Aa is preferably the same as the diameter of the metal filament body 20 or a little larger than the diameter of the metal filament body 20, and specifically, the metal filament body holding member 1Aa preferably has a width which is 100 to 150% of that of the metal filament body 20. By employing such a structure, the parallel portion 20A of the facing metal filament bodies 20 is placed in the depth direction of the cutout 1A. Thus, when the both end portions of the parallel portion of the facing metal filament bodies 20 are pressed by the pressing member 1B, the same force is applied to two metal filament bodies 20, thereby suitably preventing disturbance of the shape of a knot portion. Since, when the width w1 of the metal filament body holding member 1Aa is above the above-mentioned range, the facing metal filament bodies 20 moves in the width direction, making it difficult to uniformly apply a force thereto and the shape of the knot portion is disturbed, which is not preferred.

As illustrated, the metal filament body holding member 1Aa of the cutout 1A of the fixing member 1 has an inclination angle θ1 of 0.5 to 2.5° with respect to the depth direction of the cutout 1A. When the metal filament body holding member 1Aa has the inclination angle θ1, the metal filament bodies after connection are pulled out easily, thereby further improving the workability. In cases in which the metal filament body holding member 1Aa has the inclination angle θ1, the bottom portion of the cutout 1A may be designed to have a width which is 100 to 145% of that of the metal filament body 20.

In the present invention, the guide portion 1Ab of the cutout 1A of the fixing member 1 preferably has an inclination angle θ2 of 15 to 45° with respect to the depth direction, and the guide portion 1Ab preferably has a width w2 of 10 to 20 mm. By satisfying such requirement, introduction of the facing two metal filament bodies 20 and pulling out of the metal filament body 20 after connection become easier. The shape of the cutout 2A of the rotating body 2 is preferably the same as that of the cutout 1A of the fixing member 1.

In cases in which the metal filament body is connected by using a manufacturing device of the present invention, when facing metal filament bodies are arranged, the cutout 1A of the fixing member 1 and the cutout 2A of the rotating body 2 need to be aligned. In order to facilitate such positioning, the connecting device of the present invention preferably has a positioning mechanism of the cutout 2A of the rotating body 2. For the positioning mechanism, a ball plunger or the like may be used, and a ratchet mechanism allowing one way rotation is preferred.

Figure 9:
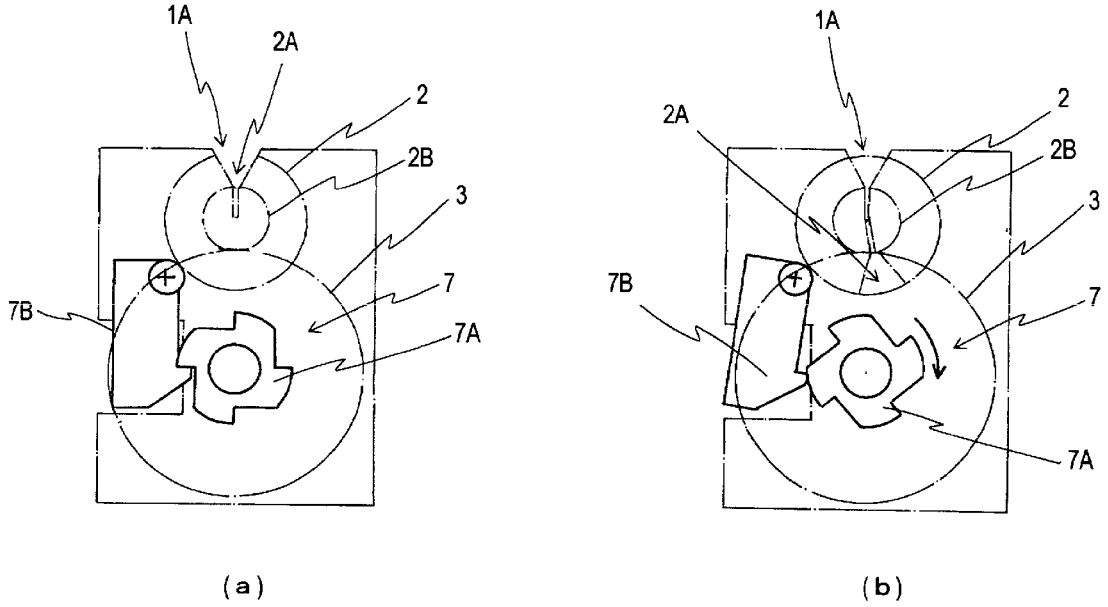
In FIG. 9, (*a*) is a diagram illustrating a state in which positioning is performed by a ratchet claw 7B; (*b*) is a diagram illustrating a state in which driving gear is rotating.

FIG. 9 is an explanatory diagram of a positioning mechanism of the cutout 2A of the rotating body 2 and the cutout 1A of the fixing member 1 in the case of using a ratchet mechanism 7. FIG. 9(*a*) is a diagram illustrating a state in which the cutout 2A of the rotating body 2 is positioned by a ratchet claw 7B, and FIG. 9(*b*) is a diagram illustrating a state in which a driving gear is rotated. As illustrated, a gear 7A of the ratchet is provided on the driving gear 3. The gear 7A of the ratchet is rotated in accordance with the rotation of the driving gear 3, and the rotation is positioned every time the ratchet claw 7B in the FIG. 9 is meshed with the gear 7A. In the illustrated example, the gear ratio of the driving gear 3 and the gear 2B of the rotating body 2 is 4:1; when the driving gear 3 is rotated once, the rotating body 2 rotates four times. In other words, when the driving gear 3 is rotated 90°, the rotating body 2 rotates once, and as the result, the position of the cutout 2A of the rotating body 2 and the position of the cutout 1A of the fixing member 1 correspond each other. Therefore, in the illustrated example, there are provided four gears 7A at 90° interval, as the ratchet mechanism 7.

Figure 10:
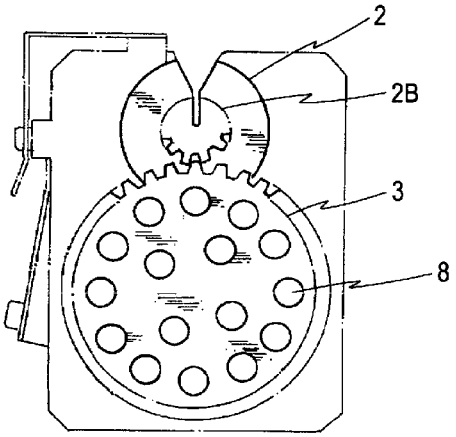
FIG. 10 is a schematic view illustrating one suitable example of a driving gear according to a connecting device of the present invention.

Since, different from a conventional connecting device, the number of members needed for the rotation mechanism is small, the connecting device is lightweight and has a compact structure. Therefore, a connecting device of the present invention has an excellent portability, and the workability of the connecting operation of the metal filament body can be improved. In the manufacturing device of the present invention, the material of each component is not particularly limited, and from the viewpoint of lightweight, aluminum or a resin material is preferably used, and for a gear which needs strength, a steel is preferably used. FIG. 10 is a schematic view illustrating one suitable example of a driving gear according to a connecting device of the present invention. As illustrated, the driving gear 3 is preferably provided with a hole 8 and lightened. By employing such a structure, further lightweight is possible, and more excellent portability is attained.

In the connecting device of the present invention, as illustrated in FIG. 3, a magnet 9 and a resin guide 10 may be provided on the back of the connecting device. Since, by this, the connecting device of the present invention can be simply fixed on a twisting machine, an operator can perform connecting operation of a metal filament body by using his/her both hands, which further improves workability.

A connecting method and connecting device of the present invention is suitably used particularly for connecting a metal filament body having a large diameter which is 0.40 mm or larger. The metal filament body of the present invention is one connected by the above-mentioned metal filament body connecting method of the present invention. Since, in such a metal filament body, the width of a knot portion of a metal filament body is small and the shape thereof is stable, a break when metal filament bodies are twisted together can be prevented.

EXAMPLES

In the following, a manufacturing method and a manufacturing device of the present invention will be described in detail by way of Examples.

Example

By using a metal filament body connecting device of a type illustrated in FIG. 1, steel filaments having a diameter of 0.45 mm were connected. A metal filament body holding member of a fixing member has an angle of 1.5° with respect to the depth direction of a cutout, and the width was 0.46 mm. On the fixing member, a guide portion having a width of 13 mm and an angle of 30° for guiding a steel filament was provided. A pressing force of the steel filament by the pressing member was set to 65 N. The plate spring had a length of 27 mm, a width of 22 mm, and a thickness of 0.7 mm. Time it took for connecting a metal wire rod by using the connecting device and the thickness of the knot portion were measured. The results are listed on Table 1.

Conventional Example

Metal filament bodies having a diameter of 0.45 mm were connected by needle-nose pliers, and time it took for the connection and the thickness of a knot portion were measured.

TABLE 1

| | Operation time (sec.) | knot portion thickness (mm) |
|---|---|---|
| Example | 25 | 0.9 |
| Conventional Example | 35 | 1.5 |

Table 1 shows that the operation time is shortened since connecting operation becomes easier than conventional one by using the connecting device of a metal wire rod of the present invention. Table 1 also shows that, by using the connecting device of the present invention, the knot portion of the metal filament body becomes small. In the case of using the connecting device of the present invention, the knot portion was not disturbed. Since the structure of the connecting device of the present invention is simple, the connecting device is lightweight and has an excellent portability.

DESCRIPTION OF SYMBOLS

1 Fixing member
1A Cutout
1Aa Metal filament body holding member
1Ab Guide portion
1B Pressing member
1C Pressing base
2 Rotating body
2A Cutout
2Aa Metal filament body holding member
2Ab Guide portion
2B Gear
3 Driving gear
4 Handle
5 Plate spring
6 Claw
7 Ratchet mechanism
7A Gear
7B Ratchet claw
8 Hole
9 Magnet
10 Resin guide
20 Metal filament body
20A Parallel portion
20B Knot portion

The invention claimed is:

1. A metal filament body connecting method of connecting facing metal filament bodies, in which a pair of fixing members fixing the facing metal filament bodies, and a rotating body including cutout which is rotatable at the gap between the pair of fixing members are arranged; both end portions of a parallel portion of a metal filament body formed by juxtaposing the facing metal filament bodies are fixed by the pair of fixing members;

an approximately central portion of the parallel portion of the metal filament body is arranged in a cutout of the rotating body; and then, the facing metal filament bodies are twisted together by rotating the rotating body, wherein the pair of fixing members comprises a cutout and a pressing member; both end portions of parallel portion of the facing metal filament bodies are arranged in cutouts of the pair of fixing members; and the both end portions are fixed by pressing with the pressing member, and the pressing member comprises a plate spring and a claw member for fixing the plate spring.

2. The metal filament body connecting method according to claim 1, wherein the cutouts of the pair of fixing members comprise a metal filament body holding member having a width of 100 to 150% with respect to the diameter of the metal filament body;

and the facing metal filament bodies are arranged side by side in a depth direction of the cutouts of the pair of fixing members.

3. The metal filament body connecting method according to claim 2, wherein the width of the metal filament body holding member is decreased with respect to the depth direction of the cutouts of the pair of fixing members by an angle of 0.5 to 2.5°.

4. The metal filament body connecting method according to claim 1, wherein the rotating body comprises a gear; the gear is engaged with a driving gear including a handle; and the rotating body is rotated by rotating the driving gear by rotating the handle.

5. A metal filament body connecting device for connecting facing metal filament bodies, comprising a pair of fixing members which can fix both end portions of a parallel portion of a metal filament body formed by juxtaposing the facing metal filament bodies, a rotating body which is rotatably arranged at the gap between the pair of fixing members including a cutout which can hold an approximately central portion of the parallel portion of the metal filament body, and a driving gear to be engaged with a gear mounted in the rotating body, wherein the pair of fixing members comprising cutouts for holding both end portions of a parallel portion of the metal filament body and a pressing member which fixes a metal filament body by pressing, and the pressing member comprises a plate spring and a claw member for fixing the plate spring.

6. The metal filament body connecting device according to claim 5, wherein the cutouts of the pair of fixing members comprise a metal filament body holding member having a width of 100 to 150% with respect to the diameter of the metal filament body.

7. The metal filament body connecting device according to claim 6, wherein the width of the metal filament body holding member is decreased with respect to the depth direction of the cutouts of the pair of fixing members by an angle of 0.5 to 2.5°.

8. The metal filament body connecting device according to claim 5, wherein the driving gear comprises a handle.

* * * * *